US007490551B2

(12) United States Patent
Golay et al.

(10) Patent No.: US 7,490,551 B2
(45) Date of Patent: Feb. 17, 2009

(54) PROJECTILE FUZE

(75) Inventors: Jean-Pierre Golay, Sion (CH); Olivier Pronini, Geneva (CH); Claude Robert-Nicoud, Vernier (CH)

(73) Assignee: SN Technologies S.A., Meyrin (CH)

( * ) Notice: Subject to any disclaimer, the term of this patent is extended or adjusted under 35 U.S.C. 154(b) by 51 days.

(21) Appl. No.: 10/547,186

(22) PCT Filed: Feb. 27, 2003

(86) PCT No.: PCT/IB03/00745

§ 371 (c)(1),
(2), (4) Date: May 11, 2006

(87) PCT Pub. No.: WO2004/076962

PCT Pub. Date: Sep. 10, 2004

(65) Prior Publication Data

US 2006/0196382 A1 Sep. 7, 2006

(51) Int. Cl.
*F42C 15/32* (2006.01)

(52) U.S. Cl. ..... 102/223

(58) Field of Classification Search ..... 102/221–224, 102/228, 229

See application file for complete search history.

(56) References Cited

U.S. PATENT DOCUMENTS 3,382,805 A * 5/1968 Swaim ..... 102/228
3,804,020 A * 4/1974 Norton ..... 102/216
3,927,617 A * 12/1975 Hoelzen et al. ..... 102/228
3,961,577 A * 6/1976 O'Steen ..... 102/208
4,002,123 A 1/1977 Fisher
4,188,886 A * 2/1980 Brauer et al. ..... 102/223
4,380,197 A 4/1983 Eaton
4,526,104 A 7/1985 Leach
4,932,325 A * 6/1990 Hutter ..... 102/223

FOREIGN PATENT DOCUMENTS

CH 650 330 7/1985
CH 693 116 2/2003

* cited by examiner

*Primary Examiner*—Bret Hayes
(74) *Attorney, Agent, or Firm*—Young & Thompson

(57) ABSTRACT

Fuze including safety element (30) includes an acceleration detector (31) that acts on a timer (32) coacting with a primer housing rotor (14). Rotation of the rotor can be halted by a second safety device (35) responsive to the dynamic pressure generated by the speed of the projectile (11) in flight. For this purpose, the device includes a diaphragm (36) engaging a flexible blade (51) to space apart the end (55) of the blade and the rotor when the dynamic pressure has a predetermined value, whereby a primer (18) can be moved into line in the explosive train. When the dynamic pressure is too low, the end (55) stops the rotor (14) from rotating and the firing procedure is also blocked in a notch in the rotor (14). The resulting fuze thus has highly reliable dual safety element responsive to two separate physical phenomena and having a simple construction.

18 Claims, 3 Drawing Sheets

PROJECTILE FUZE

FIELD OF THE INVENTION

The present invention concerns a missile fuse with an ignition device and security means intended to enable ignition of the missile only under predetermined conditions.

DESCRIPTION OF THE RELATED ART

Fuses of this type are known, for instance, as described in the patent CH 650.330. The security means of these fuses generally comprise an acceleration detector cooperating with a delay device.

SUMMARY OF THE INVENTION

It is the aim of the present invention to create a fuse having a still higher ignition security, a highly reliable function, simple design, and containing a small number of components.

To this end, the fuse according to the invention is characterised in that the security means comprise a detection device that is sensitive to the dynamic air pressure arising at the missile in flight, and that is designed so as to enable ignition of the missile when this dynamic pressure attains a predetermined value of dynamic presssure corresponding to a given speed of the missile, but to prevent ignition of the missile when the dynamic pressure does not attain this predetermined pressure value.

The dynamic pressure created by the missile in flight constitutes an additional criterion of security which allows all risks of undesired ignition to be eliminated. Such a device moreover yields a very high security and reliability while keeping a simple design with a small number of components.

Advantageously, said detection device comprises a detector element able to be at least partially displaced and/or deformed under the influence of the dynamic air pressure, so as to enable ignition when the dynamic pressure attains the predetermined value, or prevent ignition in the opposite case.

A particularly reliable function is secured by these features.

Advantageously, said detector element is able to occupy a rest position as well as an ignition position when said value of the dynamic pressure is attained, and the security means are arranged so as to definitively prevent the detector element from taking up the ignition position when the value of dynamic pressure is not attained after a predetermined period of time counted from missile launch.

The security of the fuse thus is still further enhanced by the fact that the ignition mechanism is definitely blocked when the predetermined speed is not attained within a given period of time.

In a preferred embodiment, the detector element is housed in a chamber of the fuse that is linked by a channel terminating in a hole situated in the front section of the fuse, and comprises a transmission element that can enable ignition or interrupt the ignition process.

The dynamic pressure detection device thus is well protected against all deterioration prior to or during the flight.

Highly favourably, said detector element comprises an elastic membrane retained at its borders in said chamber that can curve in under the dynamic pressure, this membrane then acting on said transmission element constituted by a flexible blade so as to deform and/or deplace it, thus allowing ignition to occur.

This design is particularly simple and reliable, and allows a fuse of doubled security and a very modest cost price to be obtained.

Further advantages will become evident from the characteristics expressed in the dependent claims and from the description in which hereinafter the invention will be set forth in greater detail with the aid of drawings representing schematically and in exemplary manner an embodiment.

DETAILED DESCRIPTION OF THE PREFERRED EMBODIMENTS

Figure 1A:
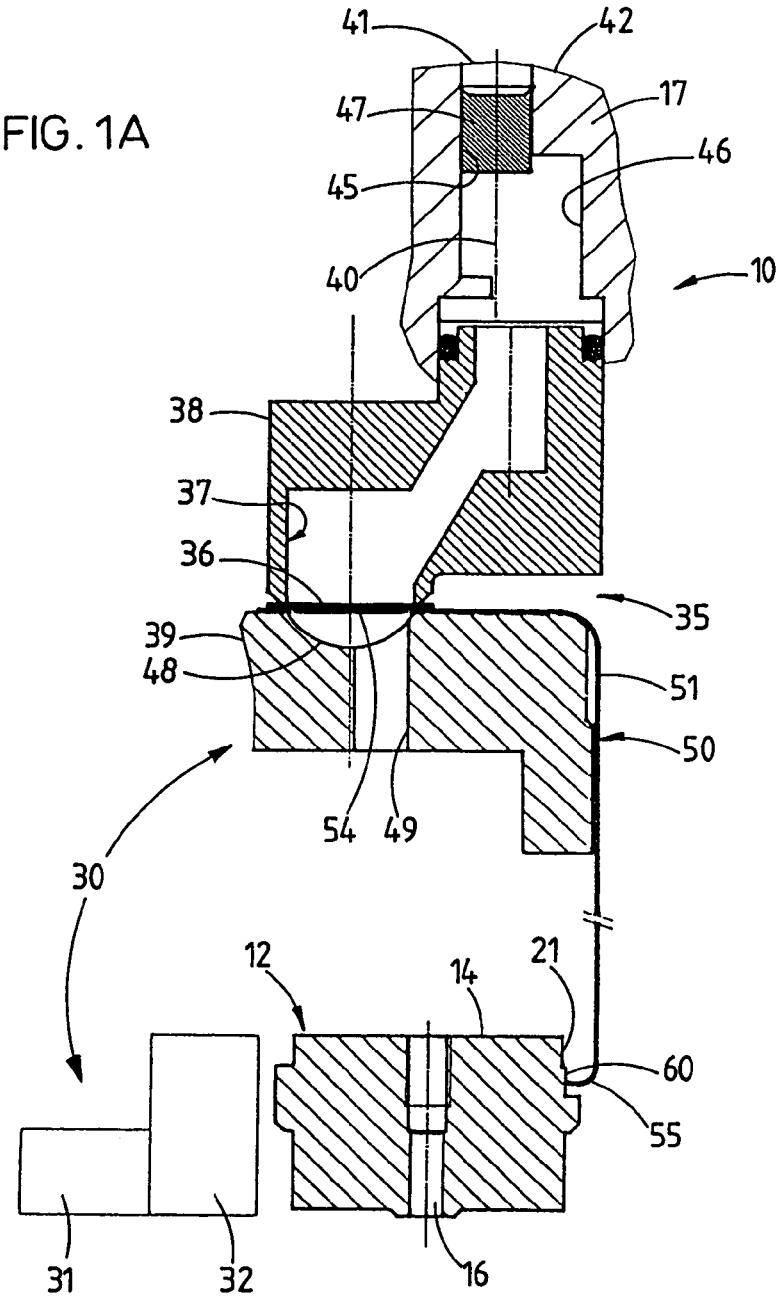
FIGS. 1A, 2A and 3A represent the fuse in partial section in three different positions.
Figure 1B:
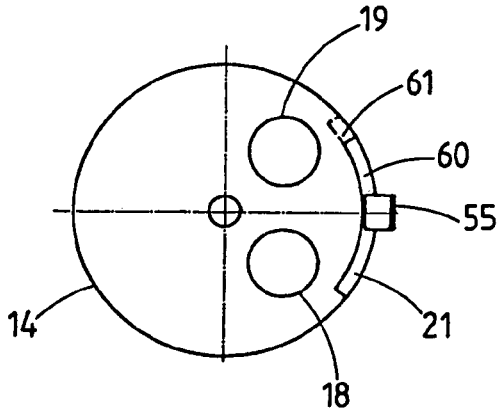
FIGS. 1B, 2B and 3B are plan views of the detonator rotor in the three different positions.
Figure 2A:
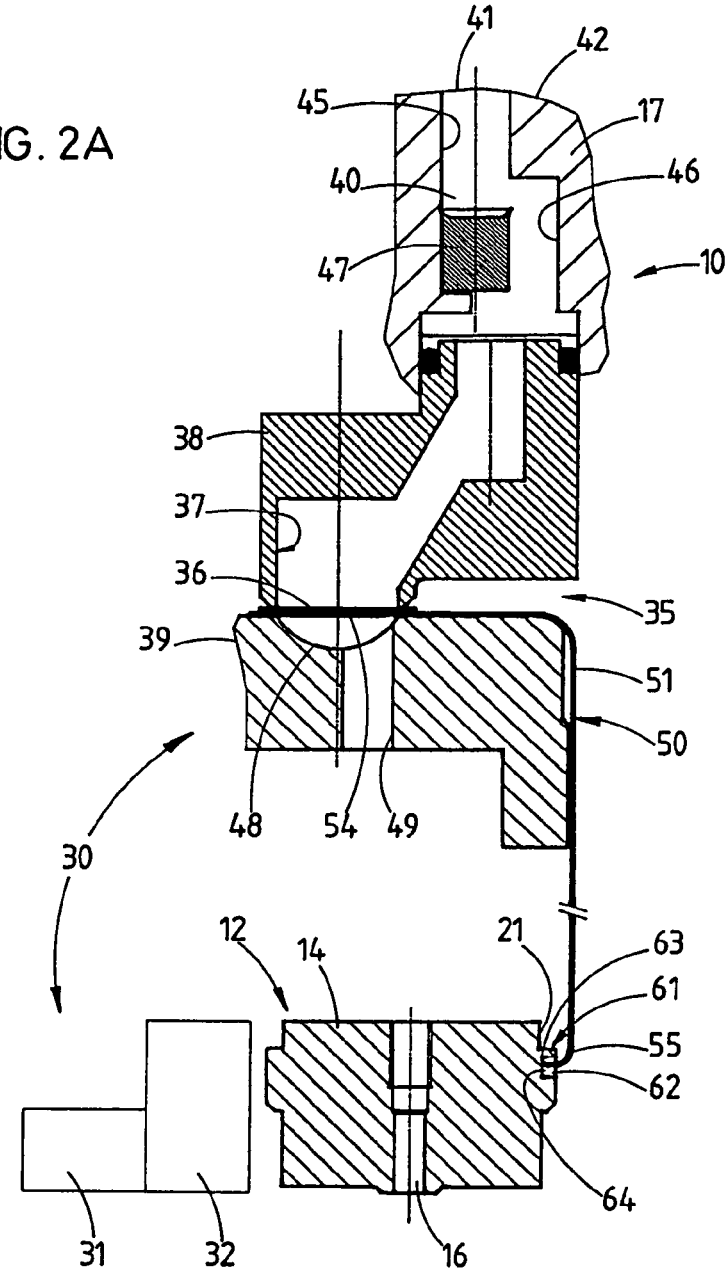
Figure 2B:
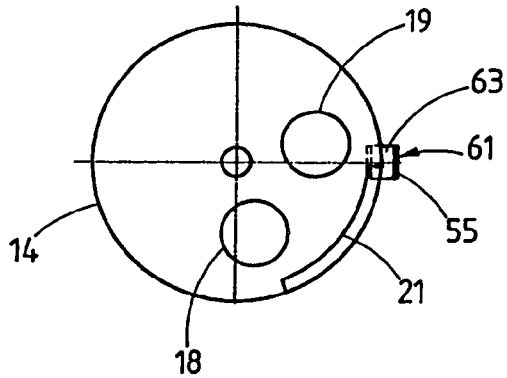
Figure 3A:
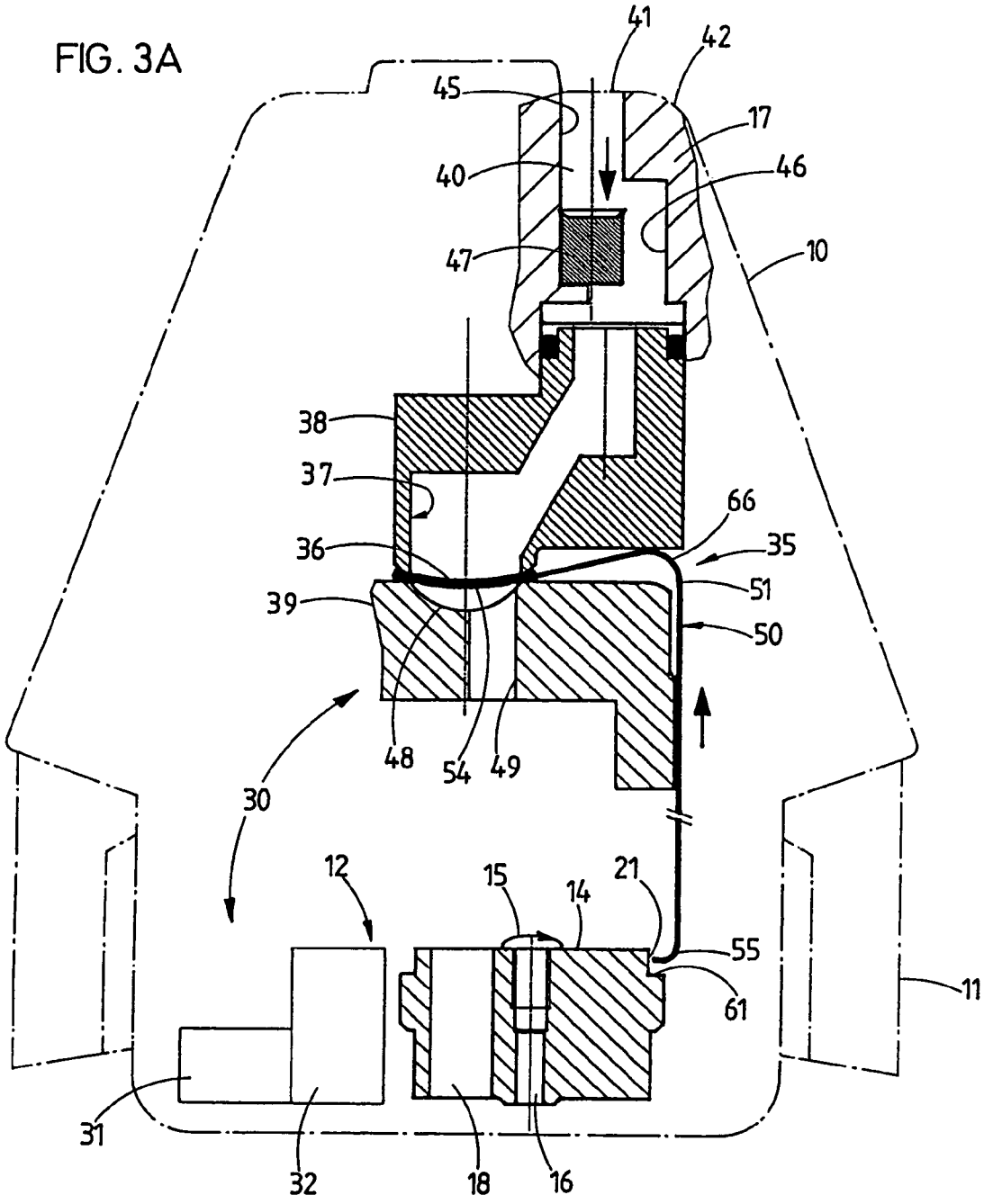
Figure 3B:
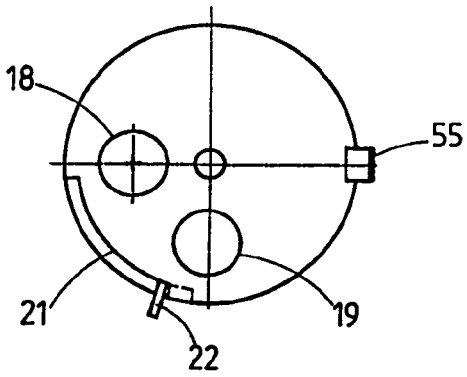

Referring to FIGS. 1A to 3A, the fuse 10 with its outer contours sketched in dash-dotted lines in FIG. 3A is intended to be mounted to the front section of a missile 11 by all adequate means, favourably with screws. Like all fuses, it comprises an ignition device 12 of which only a part is represented which is mounted rotatably in the form of a detonator rotor 14 on a shaft 16 that is integral with the body of the fuse. This rotor 14 comprises detonators 18, 19 that can be aligned by rotation of the rotor with a pyrotechnic chain (not illustrated) which in known fashion for instance includes a detonator intended to communicate the ignition to the missile's explosive charge.

The rotor can be set in rotation by a spring 15 so as to be shifted from an initial security position (FIG. 1B) to one of the ignition positions (FIG. 3B) in which one of the instantaneous or retard detonators 18, 19 is aligned within the pyrotechnic chain, depending on the position of a selector rod 22 cooperating with a peripheral cam 21.

The fuse comprises a series of security means 30 including amongst others at least an acceleration detector 31 designed to block the ignition device 12 when the acceleration of missile 11 is below a predetermined value, and to release the ignition device and initiate the ignition procedure when the acceleration is equal to or higher than this predetermined value.

This acceleration detector cooperates with a delay device 32 which in turn releases the rotor 14 after a predetermined period of delay so that it starts turning under the action of its spring.

The general design of the fuse with respect to the ignition device 12, the acceleration detector 31, the delay device 32 and the rotor 14 could for example be of the type described in Swiss patent No. 650.330 the text of which is an integral part of the present application.

Apart from the acceleration detector, at least a second security device 35 which is sensitive to another discriminating physical phenomenon, viz., the dynamic air pressure due to the missile in flight is contained in the security means 30; it is designed so that ignition will be enabled only when the dynamic pressure attains a predetermined value corresponding to a given speed of the missile, and will be prevented in the opposite case.

This second security device 35 comprises a membrane made of elastic material 36, for instance of plastic, which is housed in a chamber 37. The borders of the membrane are retained by the walls of chamber 37 by being sandwiched between an upper part 38 and a lower part 39 of the body 17.

A channel 40 links a hole 41 located in the front section 42 of the fuse to chamber 37. This channel 40 has a first section 45 with a cross section smaller than that of a second section 46 located further back. In the state of rest the first section 45 of channel 40 is entirely closed off by a plug 47. When the missile is in flight, the dynamic pressure exerted by the air displaces the plug backwards into the second section 46 and thus opens channel 40 so that the membrane 36 is subject to the dynamic pressure of the missile in flight.

The lower part 48 of chamber 37 is rounded and linked to a ventilation channel 49. The security device 35 moreover contains a transmission element 50 intended to act upon the rotor as a function of the dynamic pressure.

This organ consists of a flexible metal blade 51 mounted on the lower part 39. A terminal section 54 of this blade 51 is inserted and held between parts 38 and 39, and is situated beneath the membrane 36. Blade 51 then follows part 39 and extends to a terminal portion 55 in the direction of rotor 14 in order to cooperate with cam 21 provided at the rotor's periphery.

This cam 21 has a recessed part 60 (FIGS. 1A and 1B) that allows the rotor 14 to rotate when the delay device has released it. It also has a stop part 61 (FIGS. 2A and 2B) with a first stop 62 that is arranged to stop the rotation of rotor 14 when the terminal portion 55 of blade 51 has not been lifted, and a second stop 63 intended to retain the flexible blade 51 in its low position within a notch 64 formed by the first and second stop.

The fuse functions as follows. Prior to the missile's launch, the mobile elements of the fuse are at their rest positions shown in FIGS. 1A and 1B. After launch the plug 47 rapidly retreats to open the air channel 40 so that a dynamic air pressure is established in chamber 37. Membrane 36 and section 54 of blade 51 curve downwards when this dynamic pressure attains a sufficiently high predetermined value, for instance 3 bars. The flexible blade 51 then forms a loop 66 curving upwards in its central section (FIG. 3A), and its lower end 55 is lifted above the level of the stop part 61.

Under the assumption that the missile's acceleration has a sufficiently high predetermined value, for instance 2500 g, the acceleration detector 31 is activated so as to start the delay device 32 which after a predetermined period of time releases the rotation of rotor 14. The rotor is not stopped by the blade 51 that is lifted above the stop part 61, and rotates by a predetermined angle so as to place one of the detonators 18, 19 into the pyrotechnic chain.

When the missile's speed is too low and the dynamic pressure does not attain a sufficiently high value, and is for instance less than 3 bars, while the fuse's acceleration has been larger than the predetermined minimum value, then rotor 14 is set in rotation, but its rotation is stopped by the stop part 61, FIGS. 2A and 2B. Moreover, terminal portion 55 is blocked in notch 64 under the action of spring 15 of the rotor 14. The ignition device thus is stopped and definitively blocked, none of the detonators 18, 19 is aligned with the pyrotechnic chain.

Thus, apart from the acceleration detector or detectors, the security means comprise at least one further security device sensitive to a further discriminating factor, which here is the dynamic pressure due to the missile's speed in flight. This dynamic pressure acts first of all on plug 47, which thus constitutes a first security element, and then on the security device 35 with its control blade 51. Ignition security thus is at least doubled while a simple and reliable design including few components is offered.

It is to be understood that the embodiment described hereinabove is in no way limiting and may receive all desirable modifications within the scope defined by claim 1. The security means more particularly could include still further elements, for instance elements sensitive to rotation in the case of gyrating missiles. In a simplified version the acceleration detector could be suppressed. The configuration of channel 40 and chamber 37 could be very different. Instead of a membrane 36, one could provide any other detector element for the dynamic pressure that can be at least partially displaced and/or deformed under the influence of the dynamic pressure, such as a valve urged against a rest position by a spring, or a braked airwheel set in rotation by the air under dynamic pressure. The detector element could cooperate with any mechanical or electrical component of the pyrotechnic chain. In the case of an electric fuse, it could for instance short-circuit the ignition charge when the missile's speed is insufficient. It could equally well act upon the delay device by releasing it only under predetermined conditions of the dynamic pressure.

The invention claimed is:

1. A missile fuse, comprising:

an ignition device (12); and a security means (30), intended to enable ignition of a missile only under predetermined conditions, including a detection device (35) configured i) to be sensitive to a dynamic air pressure arising at the missile (11) in flight, and ii) to enable the ignition of the missile when the dynamic pressure attains a predetermined value of dynamic pressure corresponding to a given speed of the missile, and further configured to prevent the ignition of the missile when the dynamic pressure does not attain the predetermined pressure value, wherein the detection device comprises a detector element (36) configured to be, under the influence of the dynamic air pressure, any of displaced and deformed, so as to enable the ignition of the missile if the dynamic pressure attains the predetermined value, and to prevent the ignition of the missile if the dynamic pressure does not attain the predetermined pressure value, wherein the detector element (36, 50) cooperates with a mobile mechanical element (14), the mobile mechanical element (14) configured to be displaceable from an initial position to an ignition position after launch of the missile, the detector element (36, 50) being configured i) to prevent the mobile mechanical element (14) from being displaced to the ignition position when the value of dynamic pressure is not attained, and ii) to move away from the mobile mechanical element, and thereby not prevent the mobile mechanical element (14) from being displaced to the ignition position, when the value of dynamic pressure is attained, wherein the mobile mechanical element consists of a detonator rotor (14), a periphery of the detonator rotor (14) being configured to cooperate with a section (55) of a flexible blade (51), and wherein the periphery of the detonator rotor (14) comprises i) a first retaining element (62) preventing rotation of the rotor to the ignition position when the section (55) is not lifted from the periphery, and ii) a second retaining element (63, 64) configured to prevent the flexible blade (51) from moving away from the periphery when the rotation of rotor (14) has been prevented by the flexible blade (51).

2. The fuse according to claim 1, wherein the detector element (36, 50) is configured to occupy either of a rest position and the ignition-enabling position, wherein the security means (30) are configured to definitively prevent the detector element (36, 50) from occupying the ignition-enable position when the value of dynamic pressure is not attained after a predetermined period of time counted from missile launch.

3. The fuse according to claim 1, wherein the detector element (36) is housed in a chamber (37) of the fuse and linked by a channel (40) to a hole (41) situated in a front section (42) of the fuse, and wherein the detector element comprises a transmission element (50) configured i) to enable the ignition and ii) to interrupt an ignition process.

4. The fuse according to claim 3, wherein the detector element further comprises an elastic membrane (36, 50) having borders, the borders of the elastic membrane being retained in said chamber (37), and wherein the elastic membrane is configured to curve in under the dynamic pressure and to act on said transmission element (50) so as to deform and/or displace a flexible blade (51) of the transmission element to enable the ignition.

5. The fuse according to claim 1, further comprising:

an acceleration detector (31) configured to block the ignition device (12) when an acceleration of the missile is less than a predetermined acceleration value, and to release the ignition device and initiate an ignition procedure when the acceleration is equal or greater than the predetermined acceleration value.

6. The fuse according to claim 5, further comprising:

a delay element (32), wherein the acceleration detector (31) is configured to cooperate with the delay element (32), and the delay element is configured to control the ignition procedure and the rotation of the detonator rotor (14).

7. The fuse according to claim 3, further comprising:

a plug (47) in a first section (45) of said channel (40), wherein the plug, in a first mode, is in a first section (45) of said channel (40), closing off said channel (40), and wherein the plug is displaceable by the dynamic pressure to be in a second section (46) of the channel in a second mode, said channel not closed off by the plug in the second mode.

8. A missile fuse, comprising:

an ignition device (12); and a security means (30), intended to enable ignition of a missile only under predetermined conditions, including a detection device (35) configured i) to be sensitive to a dynamic air pressure arising at the missile (11) in flight, and ii) to enable ignition of the missile when the dynamic pressure attains a predetermined value of dynamic pressure corresponding to a given speed of the missile, and further configured to prevent ignition of the missile when the dynamic pressure does not attain the predetermined pressure value, wherein the detection device comprises a detector element (36) configured to be, under the influence of the dynamic air pressure, any of displaced and deformed, so as to enable ignition if the dynamic pressure attains the predetermined value, and to prevent ignition if the dynamic pressure does not attain the predetermined pressure value, wherein the detector element (36, 50) is configured to occupy either of a rest position and an ignition-enabling position, wherein the security means (30) are configured to definitively prevent the detector element (36, 50) from occupying the ignition-enabling position when the value of dynamic pressure is not attained after a predetermined period of time counted from missile launch, and wherein the detector element (36, 50) cooperates with a mobile mechanical element (14), the mobile mechanical element (14) configured to be displaceable from an initial position to an ignition position after launch of the missile, the detector element (36, 50) being configured i) to prevent the mobile mechanical element (14) from being displaced to the ignition position when the value of dynamic pressure is not attained, and ii) to move away from the mobile mechanical element, and thereby not prevent the mobile mechanical element (14) from being displaced to the ignition position, when the value of dynamic pressure is attained.

9. The fuse according to claim 8, wherein the detector element (36) is housed in a chamber (37) of the fuse and linked by a channel (40) to a hole (41) situated in a front section (42) of the fuse, and wherein the detector element comprises a transmission element (50) configured i) to enable the ignition and ii) to interrupt an ignition process.

10. The fuse according to claim 9, wherein the detector element further comprises an elastic membrane (36, 50) having borders, the borders of the elastic membrane being retained in said chamber (37), and wherein the elastic membrane is configured to curve in under the dynamic pressure and to act on said transmission element (50) so as to deform and/or displace a flexible blade (51) of the transmission element to enable the ignition.

11. The fuse according to claim 9, further comprising:

a plug (47) in a first section (45) of said channel (40), wherein the plug, in a first mode, is in a first section (45) of said channel (40), closing off said channel (40), and wherein the plug is displaceable by the dynamic pressure to be in a second section (46) of the channel in a second mode, said channel not closed off by the plug in the second mode.

12. The fuse according to claim 8, further comprising:

an acceleration detector (31) configured to block the ignition device (12) when an acceleration of the missile is less than a predetermined acceleration value, and to release the ignition device and initiate an ignition procedure when the acceleration is equal or greater than the predetermined acceleration value.

13. The fuse according to claim 12, further comprising:

a delay element (32), wherein the acceleration detector (31) is configured to cooperate with the delay element (32), and the delay element is configured to control the ignition procedure and the rotation of the detonator rotor (14).

14. A missile fuse, comprising:

an ignition device (12); and a security means (30) , intended to enable ignition of a missile only under predetermined conditions, including a detection device (35) configured i) to be sensitive to a dynamic air pressure arising at the missile (11) in flight, and ii) to enable ignition of the missile when the dynamic pressure attains a predetermined value of dynamic pressure corresponding to a given speed of the missile, and further configured to prevent ignition of the missile when the dynamic pressure does not attain the predetermined pressure value, wherein the detection device comprises a detector element (36) configured to be, under the influence of the dynamic air pressure, any of displaced and deformed, so as to enable ignition if the dynamic pressure attains the predetermined value, and to prevent ignition if the dynamic pressure does not attain the predetermined pressure value, and wherein the detector element (36) is housed in a chamber (37) of the fuse and linked by a channel (40) to a hole (41) situated in a front section (42) of the fuse, wherein the detector element comprises a transmission element (50) configured i) to enable ignition and ii) to interrupt an ignition process, and wherein the detector element (36, 50) cooperates with a mobile mechanical element (14), the mobile mechanical element (14) configured to be displaceable from an initial position to an ignition-enabling position after launch of the missile, the detector element (36, 50) being configured i) to prevent the mobile mechanical element (14) from being displaced to the ignition position when the value of dynamic pressure is not attained, and ii) to move away from the mobile mechanical element, and thereby not prevent the mobile mechanical element (14) from being displaced to the ignition position, when the value of dynamic pressure is attained.

15. The fuse according to claim 14, wherein the detector element further comprises an elastic membrane (36, 50) having borders, the borders of the elastic membrane being retained in said chamber (37), and wherein the elastic membrane is configured to curve in under the dynamic pressure and to act on said transmission element (50) so as to deform and/or displace a flexible blade (51) of the transmission element to enable the ignition.

16. The fuse according to claim 14, further comprising;

a plug (47) in a first section (45) of said channel (40), wherein the plug, in a first mode, is lit a first section (45) of said channel (40), closing off said channel (40), and wherein the plug is displaceable by the dynamic pressure to be in a second section (46) of the channel in a second mode, said channel not closed off by the plug in the second mode.

17. The fuse according to claim 14, further comprising:

an acceleration detector (31) configured to block the ignition device (12) when an acceleration of the missile is less than a predetermined acceleration value, and to release the ignition device and initiate an ignition procedure when the acceleration is equal or greater than the predetermined acceleration value.

18. The fuse according to claim 17, further comprising:

a delay element (32), wherein the acceleration detector (31) is configured to cooperate with the delay element (32), and the delay element is configured to control the ignition procedure and the rotation of the detonator rotor (14).

* * * * *